US005443435A

United States Patent [19]

Wilkinson

[11] Patent Number: 5,443,435

[45] Date of Patent: Aug. 22, 1995

[54] ADJUSTABLE LENGTH, ADJUSTABLE WEIGHT, ADJUSTABLE SHOCK ABSORPTION, MULTI-PURPOSE EXERCISE/SPORT POLES

[76] Inventor: William T. Wilkinson, P.O. Box 378, Chesapeake City, Md. 21915

[21] Appl. No.: 200,916

[22] Filed: Feb. 22, 1994

Related U.S. Application Data

[63] Continuation of Ser. No. 846,053, Mar. 5, 1992, abandoned.

[51] Int. Cl.[6] ..... A63B 23/12

[52] U.S. Cl. ..... 482/74; 482/51; 482/109; 482/50

[58] Field of Search ..... 482/93, 109, 74, 49, 482/50; 273/84 R; 135/65, 66, 74, 75, 76

[56] References Cited

U.S. PATENT DOCUMENTS

| | | | |
|---|---|---|---|
| 83,228 | 10/1868 | Warne | 273/84 R |
| 3,371,930 | 5/1968 | Shiga | 273/84 R |
| 4,218,057 | 8/1980 | Wilson | 482/74 |
| 4,351,348 | 9/1982 | Axton . | |
| 4,664,373 | 5/1987 | Hait | 482/109 |
| 4,688,788 | 8/1987 | Olufs . | |
| 4,756,524 | 7/1988 | Cooney | 135/75 |
| 5,149,092 | 9/1992 | Parsons | 273/84 R |

FOREIGN PATENT DOCUMENTS 2407464 8/1975 Germany .

OTHER PUBLICATIONS

USA Today, Advertisement for NordicTrack, Sep. 28, 1992, p. 12A.

*Primary Examiner*—Lynne A. Reichard
*Attorney, Agent, or Firm*—Connolly & Hutz

[57] ABSTRACT

An exercise device having at least one shaft, and a weight attached to the shaft. The weight may be attached in a variety of ways, and the amount of weight may be varied, depending on the users needs.

27 Claims, 2 Drawing Sheets

ADJUSTABLE LENGTH, ADJUSTABLE WEIGHT, ADJUSTABLE SHOCK ABSORPTION, MULTI-PURPOSE EXERCISE/SPORT POLES

This application is a continuation of application Ser. No. 07/846,053 filed on Mar. 5, 1992 now abandoned.

BACKGROUND OF THE INVENTION

The exercising industry is a growing industry. There is always a need for exercise devices that are economical and can be used in a number of different of exercises. Hand held weights have been found to enhance the benefits of walking or running. However, there is a need for weighted walking poles.

U.S. Pat. No. 4,688,788 issued to Olufs addresses the need for an exercising pole for walking. However, there are some problems with Olufs' pole. For example, the pole is not adjustable. Additionally, the weight is forced inside the hollow core near the grip.

SUMMARY OF THE INVENTION

An object of this invention is to provide an adjustable exercise device in the form of a pole or poles that can be used for exercises such as walking, roller blading, roller skating, jogging, skiing, skate boarding, aerobics, hiking, mountain climbing, fishing, golfing, etc.

Another object of this invention is to have weights placed at the bottom of the exercise device.

Another object of this invention is to have weights placed at the top of the exercise device.

Another object of this invention is to have a series of slug weights placed inside the hollow shaft of the exercise device.

Another object of this invention is to have weights placed on the outside of the exercise device.

Another object of this invention is to have a method of exercising with the poles.

The exercise device is used primarily for various sports/exercise The exercise device can be used for other activities by attaching a different type of feet.

In accordance with this invention the exercise device is in the form of a pole which can serve various purposes while engaging in an activity such as:

a) exercise for upper body/arms
b) balance
c) support, weight bearing reduces leg pressure, rehabilitation (like a cane)
d) protection—to fend off an attacker (animal or human).

A DETAILED DESCRIPTION OF THIS INVENTION

Figure 1:
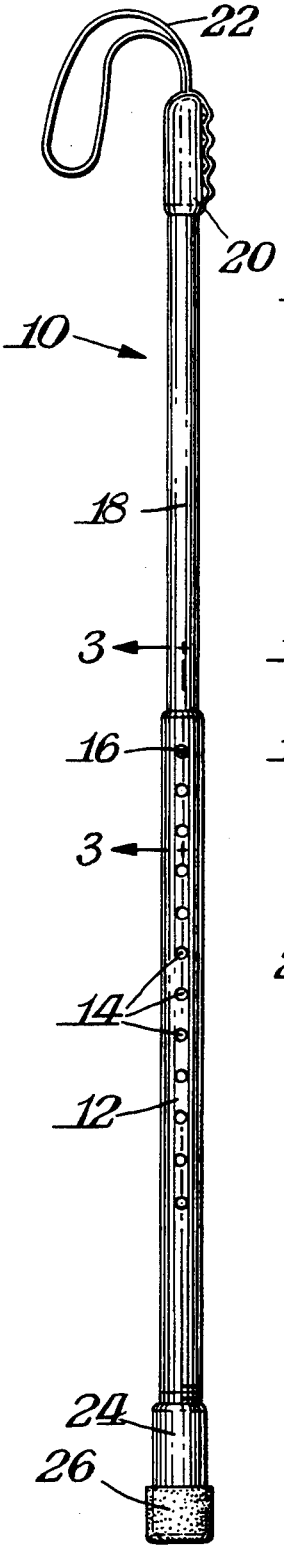
FIG. 1 is a side elevational view of an exercise device in accordance with this invention.

FIG. 1 illustrates an exercise device 10 in accordance with this invention. Device 10 is useful for various types of exercise programs. Advantageously, the device 10 can be used by numerous individuals of different sizes and ages in accordance with different exercise needs. This is possible in part from the dimensional adjustability of the different components forming device 10.

In the general device 10 includes a hollow outer tubular shaft 12, which forms a main component of this device. The hollow tubular shaft 12 can be made from any material such as, but not limited to a suitable metal or plastic. The hollow tubular shaft 12 has a series of aligned holes 14. The bottom of the hollow tubular shaft 12 can be threaded. A telescopic inner shaft 18 having a smaller diameter than the hollow outer tubular shaft 12 fits inside the hollow tubular shaft 12. The telescopic shaft 18 can be solid or hollow and can be made of any material such as but limited to plastic or metal. At the bottom of the telescopic shaft 18 is a spring button lock 16 which selectively fits inside the series of aligned holes 14 to lock the telescopic shaft 18 in a fixed position. A handle 20 fits over the telescopic shaft 18. The handle 20 is contoured and can be made of any material such as rubber, plastic or foam. The handle also has a strap 22 fixed to its top as shown in FIG. 1. The strap can be adjustable. Screw-on weight 24 is attached to the bottom of the hollow tubular shaft 12 or the top of the telescopic shaft 18. Screw-on weight 24 can be of any weight. The preferred weight would range from one half pounds to ten pounds. Attached to the bottom of the screw-on weight 24 is a foot 26. The foot can be a non-slip foot made of any material such as rubber or plastic.

Figure 2:
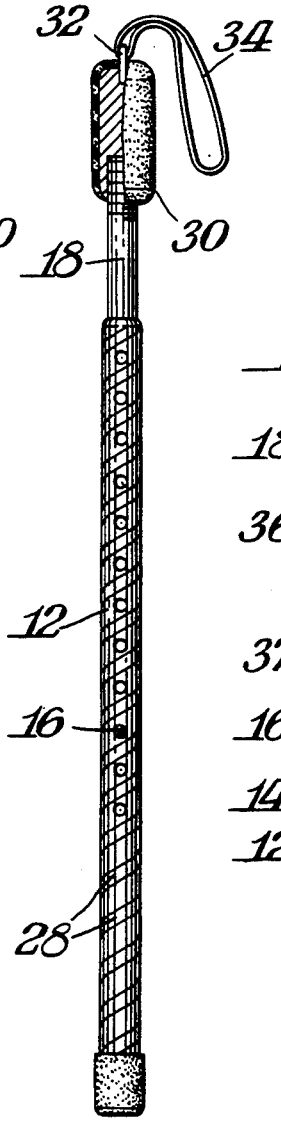
FIG. 2 is a side elevational view partly in section of a further exercise device in accordance with this invention.

FIG. 2 shows the device 10 of FIG. 1 with reflective tape 28 wrapped around the hollow tubular shaft 12 and telescopic shaft 18. In addition the telescopic shaft 18 is preferably threaded at its top. Screw-on weight 24 is be screwed onto the top of the telescopic shaft 18. A foam handle is placed over the top of the screw on weight 24. An eyelet 32 is attached to the screw on weight 24. A strap 34 extends through the eyelet 32. The strap 34 can be adjustable or fixed. A foot 26 is placed at the end of the hollow tubular shaft 12.

Figure 3:
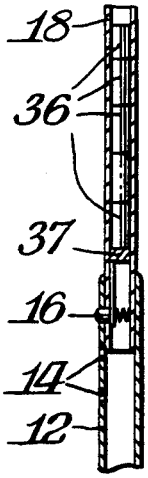
FIG. 3 is a cross-sectional view taken along the line 3—3 of FIG. 1.

FIG. 3 shows another embodiment of this invention. Small weight slugs 36 are lowered into the telescopic shaft 18. The telescopic shaft 18 is partly hollow with a stop 37 at its bottom. The small weights 36 have a smaller diameter than the shaft 18 and are dropped into the shaft 18 and stop at the bottom of the shaft. The user could put as many weights in as desired to get the results intended. Alternatively a material such as a liquid or sand may be poured into the telescopic shaft 18 to act as a weight.

Figure 4:
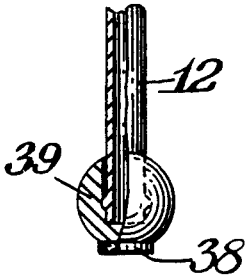
FIG. 4 is a fragmental cross-sectional view of an alternate weight attachment to the exercise device shown in FIG. 1.

FIG. 4 is a fragmental cross-sectional view of the alternate weight attachment. FIG. 4 shows a snap-on ball weight 39 that is snapped on to the bottom of the hollow tubular shaft 12. The snap-on bail weight 39 can come in different sizes and different weights depending on the desired weight by the user. At the bottom of the snap-on ball weight 39 is a no slip pad 38.

Figure 5:
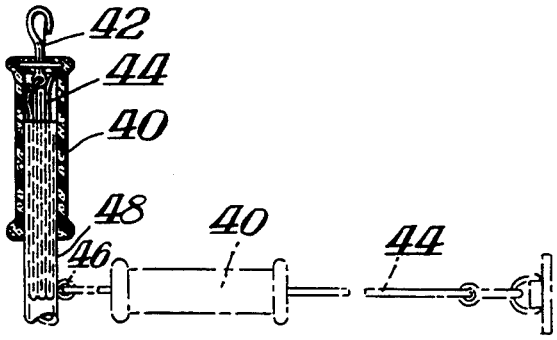
FIG. 5 is a fragmental cross-sectional view of a handle and upper shaft having resistance cords stored in the handle and shaft.

FIG. 5 shows a fragmental cross-sectional view of a handle 40 and telescopic shaft 18 having resistance cords 44 stored in the handle and shaft. In this embodiment the telescopic shaft 18 is hollow as shown in FIG. 5. The handle 40 fits over the telescopic shaft 18. A snap fastener 42 would fit through the handle 40 and inside the telescopic shaft 18. Resistance cords 44 would be stored inside the shaft 18 and fit on the end of the snap fastener 42. An eyelet 46 is be attached to the telescopic shaft 18, as shown in FIG. 5. As shown in phantom the handle 40 can be removed from the telescopic shaft 18 and the snap fastener 42 can be attached to the eyelet 46 on shaft 18. The resistance cords 44 are fastened at one end to the snap fastener 42 inside the handle 40 as can be seen in FIG. 5. The other end of the resistance cords then can be attached to anything else such as a snap, belt, etc.

Elastic resistance means could also be attached to the poles to make moving them more difficult and thus generate more exercise. The cords could be anchored anywhere on the body, but preferably at the waist.

Figure 6:
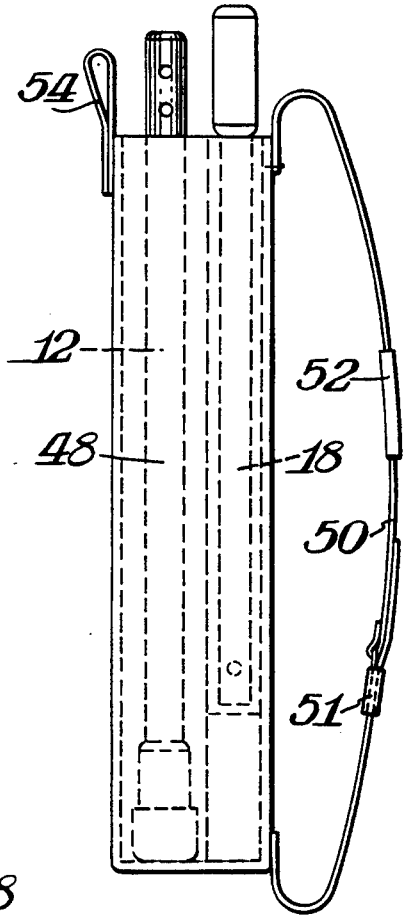
FIG. 6 is an elevational view of a storage case with collapsed shaft sections stored therein.

FIG. 6 shows an elevational view of a storage case with the tubular shaft 12 disconnected from the telescopic shaft 18. The two disconnected shafts are put inside the storage case 48. It would also be possible to fully telescope the shaft 18 inside the tubular shaft 12 for storage purposes. Attached to this storage case 48 is an adjustable strap 50. The adjustable strap 50 is adjusted by sliding the strap through the sleeve 51 and adjusting the strap 50. The adjustable strap 50 can have a shoulder pad on it 52. There can be an optional loop 54 attached to the top of the storage case 48 as seen in FIG. 6 for attachment to a belt.

Figure 7:
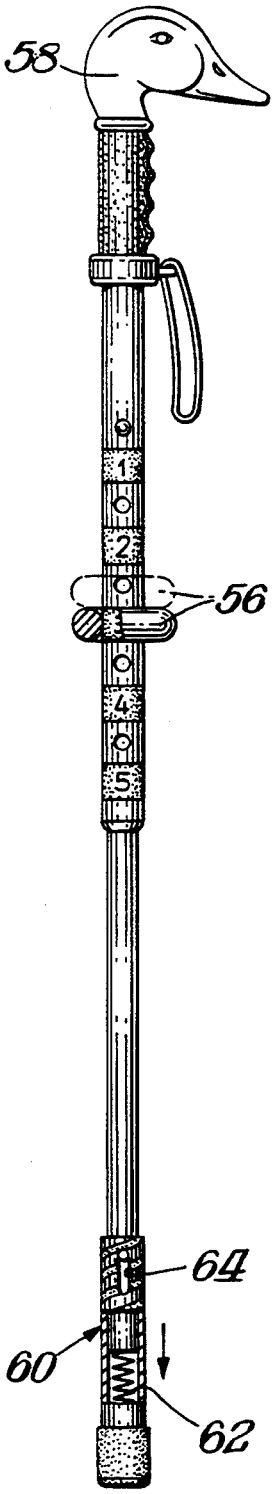
FIG. 7 is a side-elevational view of a further embodiment of an exercise device in accordance with this invention.

FIG. 7 shows a side-elevational view of a further embodiment of a walking stick. In this embodiment outer shaft 12 is shown to be at the top although this aspect of the invention could be practiced with telescopic shaft 18 at the top. Donut weights 56 are fictionally attached to the top shaft 12. The shaft 12 can have a number of colored weight placements as can be seen in FIG. 7. An ornamental knob or handle 58 is attached to the outer shaft 12. A shock absorber spring tip 60 attached to the bottom of the telescopic shaft 18. The shock absorber tip 60 would have a spring biasing means 62 inside the tip. This would allow the walking stick to act as a pogo stick. The shock absorber tip 60 has a pin in slot 64 as shown in FIG. 7. The pin can be turned to engage this spring biasing means 62. A no slip foot 26 is attached at the bottom of the shock absorber tip 60.

The spring biasing means 62 can also be introduced in the various forms of this invention to give the shafts a "pogo stick" or bounces type action to relieve shock and provide a different exercise rhythm. This can be done by placing a spring at the top of the bottom shaft in a shaft attachment stick as shown in FIG. 7. The spring pin on the top of the bottom shaft can be rotated 180° to fall into a slot opposite the adjustment holes on the top shaft. The bottom section can then slide or give, the length of this slot. The spring is anchored to the top shaft (fixed in position) by a pin at the top that engages holes in the top shaft. Thus when weight is put on the exercise device, the bottom shaft moves upwards and compresses the resistance spring for the desired effect. Tension can be varied by having a) different size/length springs, and b) having a series of vertical adjustment holes to engage the spring pin at different levels.

Figure 8:
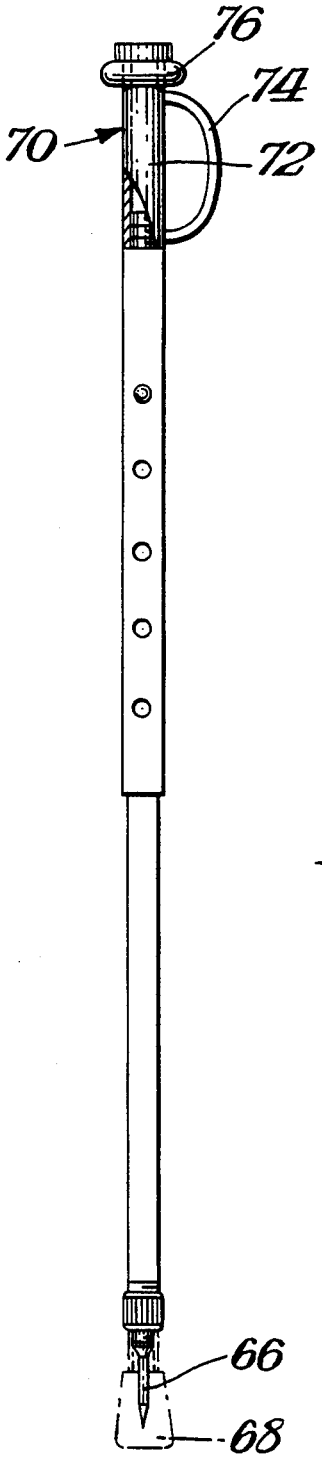
FIG. 8 is a side-elevational view of a still further embodiment of an exercise device according to this invention.

FIG. 8 shows a side-elevational view of another embodiment of a walking shaft. A screw-on hiking pick/-trash spear 66 is attached such as by being screwed to the bottom of the lower shaft 18 where the shafts are arranged as in FIGS. 1–2 outer shaft 12 is the lower shaft. A screw-on tip 68 can be screwed on to the bottom of the hiking pick thereby covering up the point. A dumb bell weight 70 is attached to the top of the outer shaft 12. A dumb bell weight 70 consists of a dumb bell grip 72, a dumb bell strap 74 and a dumb bell weight 76. The dumb bell grip 72 is attached to the shaft 12. The dumb bell strap 74 is attached to the dumb bell grip 72. The dumb bell weights sit above the dumb bell strap and are attached to the very top of the shaft 12. Additional weights can be placed on the shaft 12.

Figure 9:
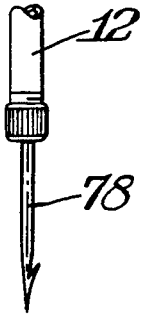
FIG. 9 is a side-elevational view of fishing gaff attachment to the lower section of an exercise device according to this invention.
Figure 10:
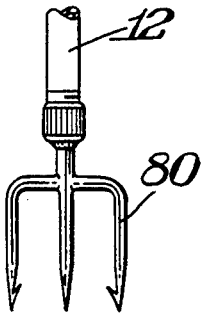
FIG. 10 is a side-elevational view of frogging gaff attachment to the lower section of an exercise device according to this invention.
Figure 11:
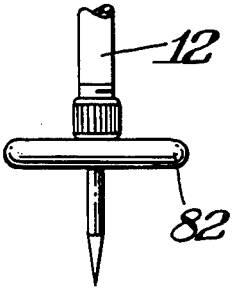
FIG. 11 is a side-elevational view of a ski pole attachment to the lower section of an exercise device according to this invention.

FIGS. 9 through 11 show different attachments that can be placed at the bottom of the lower shaft. FIG. 9 shows a fishing gaff 78. FIG. 10 shows a frogging gaff attachment 80. FIG. 11 shows a ski pole attachment 82. It is also possible attach different golf club heads to the bottom of the lower shaft.

Figure 12:
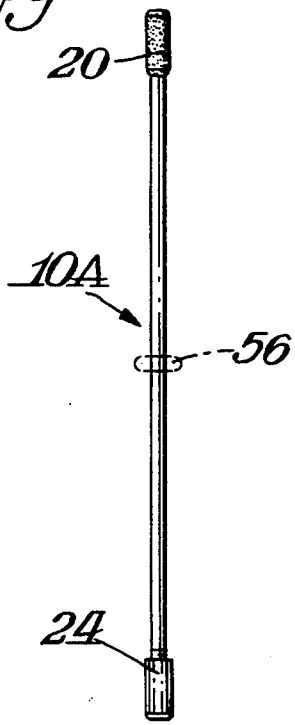
FIG. 12 is a side elevational view of a still further embodiment an exercise device in accordance with this invention.

FIG. 12 shows the exercise device 10A. The exercise device 10A consists of a shaft 11 which can be solid or hollow. The shaft 11 is not adjustable. The shaft 11 can be made from any material and ranges from a height of about 24 inches to about 72 inches, and preferably from about 36 inches to about 60 inches. A screw-on weight 24 is attached to the bottom of the shaft 11. A handle 20 is attached to the top of the shaft 11. A donut weight 56 is shown in phantom attached to the middle of the shaft 11.

The exercise device can be used for other body exercises when not walking, running or other motion exercises—i.e. for exercise at rest. This can be done by the inclusion of one or more elastic cords that can be clipped/snapped onto the pole at various positions. Various resistance exercises can then be done such as:

1) arm cuds
2) leg squats
3) shoulder shrugs
4) bench presses
5) rowing
6) leg presses
7) arm presses The cords can be stored easily, such as inside hollow handles that screw on the top of the shaft. The ends can attach to the shaft by loops or clips.

Weights can be added or subtracted in a number of ways to the poles, for a progressive exercise program, and more or less exercise.

The shaft or shafts can be hollow, as to be able to be filled with cylindrical weight slugs, such as are used in weighted vests.

Interchangeable weights can be screwed or snapped on to vary weight. Forms of such weights are ball feet, or cylindrical weighted bottoms. These variable weight pieces could be of any size or shape.

Although screw threads are illustrated as the preferred means of attachment, other attaching means may be used such as friction connection or interlocking parts.

It is to be understood that various features shown for specific embodiments can be used with other embodiments. Similarly the outer shaft 12 can be disposed at the top shaft or as the lower shaft in the various embodiments.

The basic components of the pole are:

a) One or more shaft sections—these can fit together by screwing or pressure fit. One section can telescope into the other, for easy carrying or storage. A spring pin and hole telescoping mechanism can be used to adjust the length of the pole for different activities, and/or different size people.

Adjustable length—the length of the pole(s) can be varied by a variety of mechanisms such as:

a) telescoping, spring pin and hole
b) telescoping, screw/clamp ring collar
c) two or more sections that screw or pressure fit together
d) one or more sections joined by a folding hinge.

The purpose of adjustable length is for different sports, size people, compactness for carrying or storage. The pole can also be a single non-adjustable shaft.

b) Adjustable Weight (Amount)—The weight of the poles can be varied by adding weight in a number of ways:
   a) placing weights inside hollow poles or handles;
   b) placing weights on the poles or handles. Weights can be screwed, clipped, clamped, hooked or pinned onto the shafts/handles. Magnetic weights can be placed on the shafts. Doughnut-type weights can be slid onto the shaft and "stacked";
   c) Weights can be screwed or pressure fitted onto the tops or bottoms of the shaft and handles. Screw-off feet of different sizes can be used to vary the weight of the shafts.

Varying the amount of weight allows the user to engage in a progressive exercise program and adjust the "feel" of the poles.

The weights can also be designed to be moveable up and down the shaft, instead of only being in one fixed position. This produces a "metronome" effect that permits the user to vary the feel, swing rate, and wrist/arm torque required to move the poles. Again, weights can be positioned using a variety of attachment means including screw clamping, wrapping with a velcro strap, or sliding up and down in a slot along the shaft.

One excellent way to adjust the position of the weight, is to have doughnut-shaped weights that slide up and down the pole. The weights are coated with a soft substance such as rubber or vinyl to prevent scratching the poles. The diameter of the "doughnut" holes is about the same as the outside diameter of the poles, so that the weights will "pressure fit" around the pole, so much that they will not slip when being used, but that with force they can be moved up and down for adjustment purposes.

The weights can range from half a pound increments up to 15 pounds and preferably from 1 pound up to 5 pound increments.

To aid the user in balancing the weight equally on each pole, colored/lettered or numbered hash marks are placed on each pole for reference. These also serve to identify the level of placement for the degree of exercise.

The pole can also have the following additional features:

a) Handle or padded grip—the grip can have a detachable decorative knob at the top. The grip also has molded plastic guards above and below the hand to prevent slippage. A wrist or hand strap is attached to the handle to allow for a relaxed grip, and to prevent poles from being dropped.
b) Permanent or detachable foot—the foot has a non-slip robber base for traction. A set of interchangeable detachable feet can create a multipurpose pole(s). Different feet attachment for: walking, trash pickup, spear fishing, a pick for rough terrain or mountain climbing, golfing, etc.
c) Wrist Strap—A wrist strap is attached to the upper part of the shaft or handle, that allows and open or relaxed grip on the handle. In addition, it acts as a guard against losing a pole by dropping it.
d) Safety bands/colors—Bright fluorescent colors/-bands are used on the poles for day and night safety.
e) Dumbbell grip—The handles can be a dumbbell/-hand weight that converts to a grip by one or both ends screwing off, and one end screwing onto the top of the shaft. Thus the dumbbell handle can convert to a pole/grip handle, and/or a weighted handle and a back strap can serve as a grip strap.
f) Adjustable, padded carry strap, sling or case—-Means to carry the poles when not in use is also part of the invention. The poles can be carried in one hand, off the waist, on the solder, or slung across the back. An adjustable length, padded strap with velcro ties on each end, is a handy way to carry the poles when not in use, or hang them up for storage at home or in a gym. Another good way is a sheath, with an adjustable, padded carry strap.

I claim:

1. A pole device for the aiding of forward movement comprising:

(a) a handle,
(b) means for exercising a user's arms during the course of forward movement of the user's legs, during relative movement of the user's arms with respect to the user's body while said handle is gripped by the user's hand during the course of forward movement of the user's legs,
(c) a first shaft connected to said handle,
(d) a second shaft connected to said first shaft, one of said first and second shafts is an outer shaft and the other of said shafts is an inner shaft, said inner shaft being telescopically mounted in said outer shaft to comprise a telescopic assembly, said telescopic assembly has a ground contacting surface remote from said handle, said handle being separate and distinct from said telescopic assembly,
(e) a weight attached to one of said shafts either in the inside or on the outside of said shaft below said handle, or attached as said handle,
(f) said handle is attached to a top end of said device and said handle is capable of being gripped by user's hand, said device having a bottom end, said device being of sufficient length for the user to grip said handle during the course of forward movement while said bottom end of said device touches a ground surface, and (g) the touching of said bottom end with the ground surface comprising a push-off means to assist the user in moving forward.

2. A device as claimed in claim 1, wherein said weight is attached to the top of said pole.

3. A device as claimed in claim 1, further comprising a removable tip at the bottom of said pole.

4. A device as claimed in claim 1, including a handle mounted to the top of said pole, and said handle being attached to the top of said pole.

5. A device as claimed in claim 4, wherein including an adjustable strap attached to said handle.

6. A device as claimed in claim 1, including a non-slip foot, attached to the bottom of said pole.

7. A device as claimed in claim 1, including a grip said weight at the top of said pole and inside said grip.

8. A device as claimed in claim 1, wherein a safety strip is wrapped around at least one of said shafts.

9. The device as claimed in claim 1, further comprising an exercise cord attached to said pole.

10. The device as claimed in claim 1, wherein said weight is attached on the outside of said shaft, below said handle.

11. The device as claimed in claim 1, wherein said weight is said handle.

12. The device as claimed in claim 1, wherein said weight is attached inside one of said shafts.

13. The device as claimed in claim 1, wherein said handle comprises a textured gripping surface.

14. The device as claimed in claim 1, further comprising a shock absorbing tip attached to the bottom of said pole.

15. The device as claimed in claim 1, wherein the inner shaft is capable of being collapsed inside outer shaft when the pole is being stored.

16. A pole device for the aiding of forward movement comprising:

(a) at least one shaft forming a pole, said pole has a top end and a bottom end, (b) a handle attached to said shaft at the top end of the pole, (c) means for exercising a user's arms during the course of forward movement of the user's legs, during relative movement of the user's arms with respect to the user's body while said handle is gripped by the user's hand during the course of forward/movement of the user's legs.

(d) at least one weight being attached to the outside of said shaft below the handle, or with said weight being dropped in the top of said shaft or said weight being attached as said handle, (e) said handle is attached to a top end of said device and said handle is capable of being gripped by user's hand, said device having a bottom end, said device being of sufficient length for the user to grip said handle during the course of forward movement while said bottom end of said device touches a ground surface, and (f) the touching of said bottom end with the ground surface comprising a push-off means to assist the user in moving forward.

17. The device as claimed in claim 16, wherein said weight is attached to the top of the pole.

18. The device as claimed in claim 16, further comprising a removable tip at the bottom of said pole.

19. The device as claimed in claim 16, including a handle mounted to the top of said pole, and said handle being attached to the top of said pole.

20. The device as claimed in claim 19, wherein including an adjustable strap attached to said handle.

21. The device as claimed in claim 16, including a non-slip foot, attached to the bottom of said pole.

22. The device as claimed in claim 16, including a grip said weight at the top of said pole and inside said grip.

23. The device as claimed in claim 16, wherein a safety stripe is wrapped around said shaft.

24. The device as claimed in claim 16, wherein said weight is attached as said handle.

25. The device as claimed in claim 16, wherein said handle comprises a textured gripping surface.

26. A method of exercising comprising moving a pole wherein the pole comprises:

(a) a handle, (b) a first shaft connected to said handle, (c) a second shaft connected to said first shaft, wherein one of said first and second shafts is an outer shaft and the other of said shafts is an inner shaft, with said inner shaft being telescopically mounted in said outer shaft to comprise a telescopic assembly, whereby said telescopic assembly has a ground contacting surface remote from said handle, with said handle being separate and distinct from said telescopic assembly, (d) a weight wherein said weight is attached to one of said shafts either in the inside or on the outside of said shaft, or attached to said handle, and (e) said exercise device being of sufficient length whereby said exercise device has said handle attached to a top end of said device and said handle is capable of being gripped by user's hand and a bottom end of said device which touches a ground surface wherein said pole has one end of an exercise cord attached to said pole and the other end of said exercise cord attached to a belt on the user.

27. A method of exercising comprising swinging a pole as claimed in claim 1, in a back and forth direction with each hand wherein said hand grips said handle of the pole and said bottom end of the pole makes contact with the ground.

* * * * *